United States Patent [19]

Moustakas

[11] Patent Number: 4,606,465

[45] Date of Patent: Aug. 19, 1986

[54] EXPANSIBLE SPRING-LOADED RETENTION CLAMP FOR BOOKS OR OTHER OBJECTS

[75] Inventor: Matthew A. Moustakas, Poughkeepsie, N.Y.

[73] Assignee: Ketcham & McDougall, Inc., Roseland, N.J.

[21] Appl. No.: 689,674

[22] Filed: Jan. 8, 1985

[51] Int. Cl.[4] ..... A47B 65/00

[52] U.S. Cl. ..... 211/43; 211/13

[58] Field of Search ..... 211/43, 40, 13, 59.3, 211/51

[56] References Cited

U.S. PATENT DOCUMENTS

| | | | |
|---|---|---|---|
| 2,284,849 | 6/1942 | Schreyer | 211/43 |
| 2,334,251 | 11/1943 | Clift | 211/43 |
| 2,738,881 | 3/1956 | Michel | 211/43 X |
| 3,389,805 | 6/1968 | Yeomans | 211/43 |
| 3,679,064 | 7/1972 | Howkinson | 211/43 |
| 4,135,626 | 1/1979 | Cawood | 211/43 |
| 4,463,854 | 8/1984 | MacKenzie | 211/43 |

FOREIGN PATENT DOCUMENTS

| | | | |
|---|---|---|---|
| 1238296 | 7/1971 | United Kingdom | 211/43 |
| 1286471 | 8/1972 | United Kingdom | 211/43 |
| 1358009 | 6/1974 | United Kingdom | 211/43 |

*Primary Examiner*—Robert W. Gibson, Jr.
*Assistant Examiner*—Blair M. Johnson
*Attorney, Agent, or Firm*—Edwin E. Greigg

[57] ABSTRACT

A dual element, spring-biased clamping device such as a bookend is proposed in which the clamping pressure exerted by the elements can be varied while maintaining the relative separation of the elements. One element comprises a polygonal wall to which a tethering cord is attached, the cord being spring-mountedly held within another element. In use, successive walls of the polygonal element can be brought to bear against the retained objects in an over-center relationship of the tethering cord with edge portions disposed between adjacent walls, the over-center relationship causing the polygonal element to snap tightly into place against the retained books.

6 Claims, 7 Drawing Figures

FIG 6
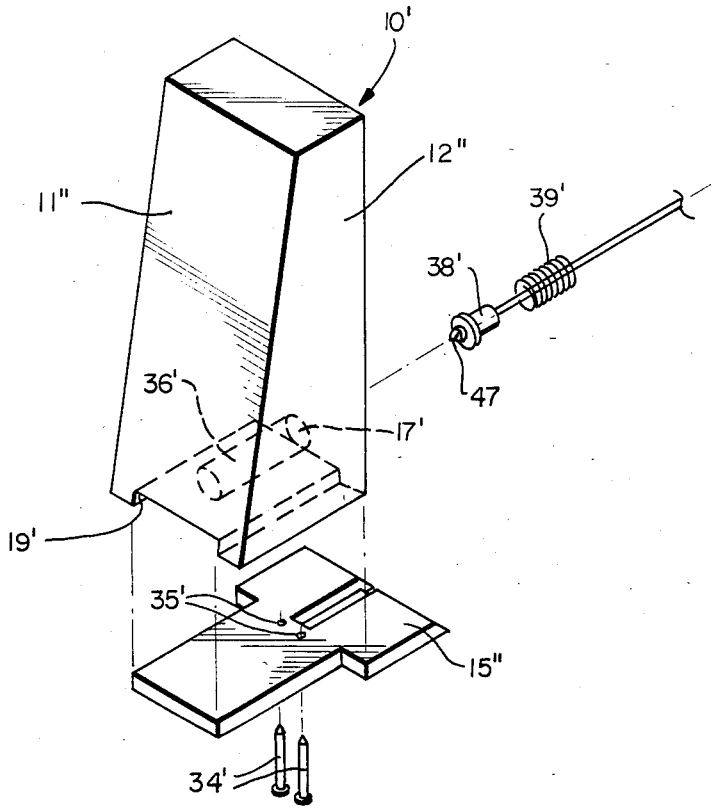
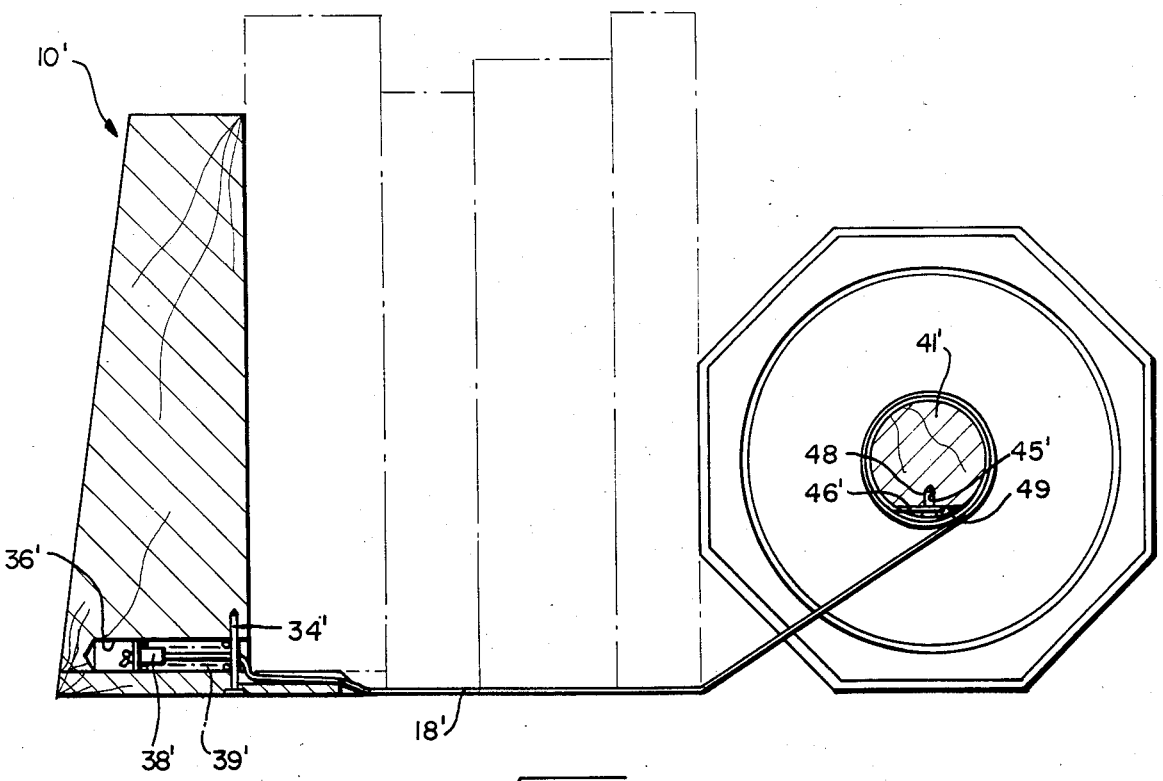
FIG 7

EXPANSIBLE SPRING-LOADED RETENTION CLAMP FOR BOOKS OR OTHER OBJECTS

BACKGROUND OF THE INVENTION

I. Field of the Invention

This invention relates to expansible retaining clamps provided with spring loading for clasping objects disposed therebetween. The invention is applicable to use for bookends and as well for use as a shop clamp for plywood or other stackable materials, for the storage and retention of objects such as records, computer diskettes, video tapes, and similar usages where their is a requirement for storing objects vertically for later use.

II. Description of the Prior Art

A number of spring loaded bookracks or clamping means are shown in the prior art. Examples of these prior art patents are that to Walker, U.S. Pat. No. 153,227, in which a spring is arranged in the base of the bookrack drawing a pair of ways against books held between the ways. Opposite ends of the spring in the Walker device draw the ways against the books in the form of a main spring.

Another illustration of a spring loaded bookend is the patent to Schreyer, U.S. Pat. No. 2,284,849, in which a pair of complementally shaped bookends are provided, one of the bookends being provided with an elongated spring disposed laterally through one of the bookends and attached at an opposite extremity to the opposite complemental bookend. In use, a book is slipped between the two bookends and they automatically separate by expansion of the spring the requisite amount in linear travel.

A further variation on a bookend is that in the Clift U.S. Pat. No. 2,334,251, in which a pair of bookends are provided with a slot through which passes a cord, opposite ends of which are used to grasp a figure having a lug to which the cord may be attached on each bookend. The adjustment here entails winding or unwinding a number of turns of the cord on the lug or placement of it on a different lug so as to increase or decrease the expansion.

Still another variation is the patent to Bascom, U.S. Pat. No. 3,399,782, in which a pair of bookends are connected together by means of a length of elastic which expands or retracts over rollers in the walls of the bookends to take up or play out the elastic and allow for variation and separation of the bookends.

A further variation is the patent to Cawood, U.S. Pat. No. 4,135,626, which discloses a holding device to apply a constant force on objects held between complementally formed retaining clamps. A constant force spring is coiled at opposite ends of the pair of clamps and is used to draw the two objects together to hold materials therebetween or allow expansion of the bookends.

SUMMARY OF THE INVENTION

In contrast to the foregoing prior art, the instant invention provides for a pair of retaining elements formed in complemental but non-symmetrical geometric shapes which can be arranged by a spring means as well into an operative position, with a tension adjustable as the user desires to retain the objects to be held therebetween. The dual element retaining means disclosed in this invention provides for a polygonally shaped element having a base and a spring biased securing element therewithin allowing for adjusting the tension applied between the pair of retaining elements via a tether or connecting cord.

Another polygonally shaped element, preferably hexagonal or octagonal, is provided to which the opposite end of the cord is secured about a central shaft. A deep groove or notch is disposed in a perimetral wall of the latter polygonal element through which groove or slot the cord may pass in a radial orientation; that is, the second polygonal element may be wound or wrapped in the direction of the first polygonal element with the cord wrapping around the central shaft means therewithin. At the point where compression resistance is provided by objects disposed between the pair of polygonal elements, the second polygonal element may be wound one or more "steps" further in the direction of the first polygonal element, each of such "steps" comprising the next side of the polygonal element, causing successive tightening stages in the compression force or clamping force exerted by the polygonal elements. In practice, the second element is moved toward the first taking up the slack by wrapping the cord around the shaft disposed on the second polygonal element, the cord being spring biased in such a way that an over-center snapping of the next polygonal wall into place occurs when the second element is further rotated against the upright objects disposed between said element and the other polygonal element.

OBJECTS OF THE INVENTION

It is a principal object of the invention to provide a pair of retaining elements for vertically storable objects in which adjustable pressure can be provided at the user's discretion to the stored objects.

It is a further object of the invention to provide a spring biased connecting cord play out and retention means for joining the retention elements together.

It is a further object of the invention to provide that the spring biased cord draws the second polygonal element toward the first polygonal element, and that an over center relationship of the peripheral sidewalls and edges of the second element can be established with the cord such that as the cord is wound around the connecting means between the faces of the second element the successive peripheral wall presented toward the first element tends to snap into place against the first element, or an object interposed between the elements, so as to tighten the grip of both elements on the contents to be retained therebetween.

Other objects and advantages of the invention become apparent by a review of the attached drawings.

BRIEF DESCRIPTION OF THE DRAWINGS

FIG. 6 is an exploded view of an alternate embodiment of the second polygonal element; and FIG. 7 is an elevational view in section of the alternate embodiment of the two polygonal elements showing a modified attachment means for the cord to the first polygonal element and mounting means for the spring bias and base of the second polygonal element.

DESCRIPTION OF THE PREFERRED EMBODIMENTS

Figure 1:
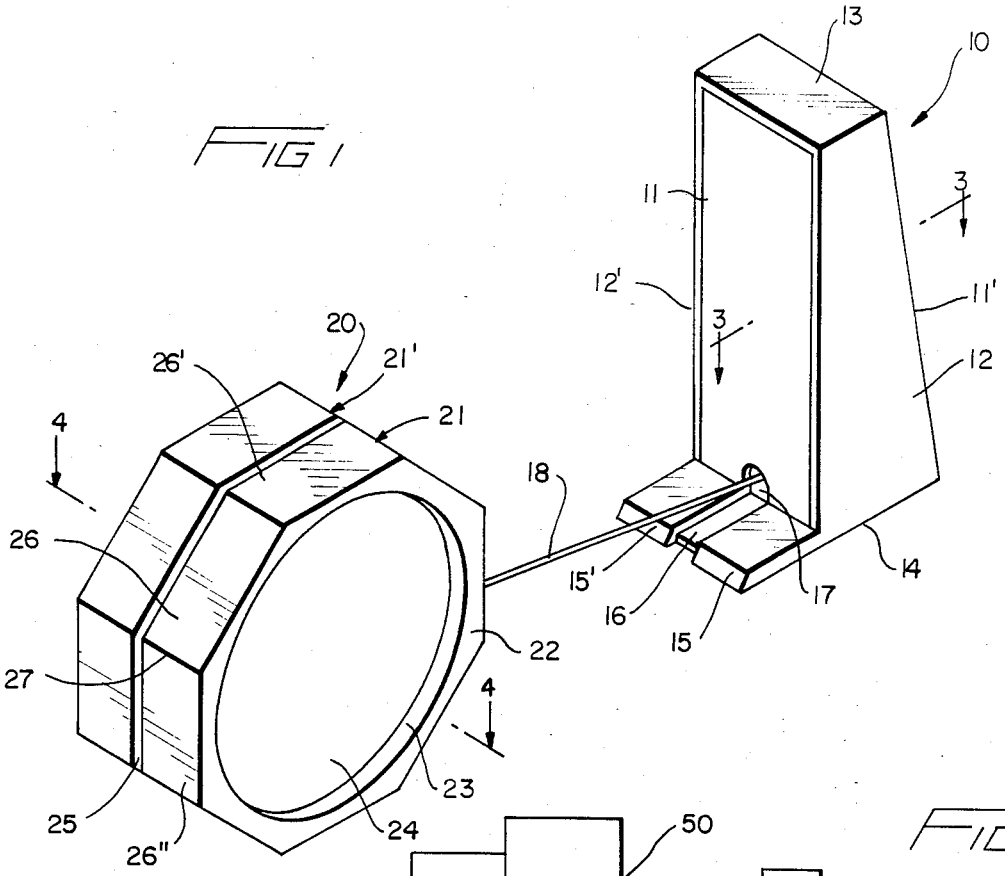
FIG. 1 is a perspective view of the dual element retaining means showing the connection therebetween.

Turning now to FIG. 1, one views both of the elements which comprise the clamp or retention means, the two elements indicated respectively as 10 and 20. The polygonal element 10' is provided with front and rear walls 11, 11', respectively, side walls 12, 12', a top wall 13 and a base wall 14, the base wall 14 having a frontal protrusion beneath the front wall 11 extending into a pair of feet 15, 15' provided with a recess 16 therebetween allowing for the passsage of a cord 18 under the stored objects and between the feet from a slot 17 into the interior of the element 10 to a retention means (not shown). The cord can be seen extending from the slot 17 in the polygonal element 10 to the other polygonal element 20, which element comprises a pair of body portions 21, 21' each provided with a perimetral wall having multiple sidewalls, such sidewalls being indicated for example as 26, 26', 26''. The polygonal element 20 has a body portion visible to the viewer in FIG. 1 including an outer planar wall 22 and an inner planar wall 24, the two walls separated by a lateral indention wall 23. The multisided polygonal element includes a deep groove between the body portions, which groove is indicated as 25, and ridge portions 27 provided at the edges between adjoining side walls forming the polygonal wall. Such a ridge portion is shown at 27 between wall 26 and 26''.

Figure 2:
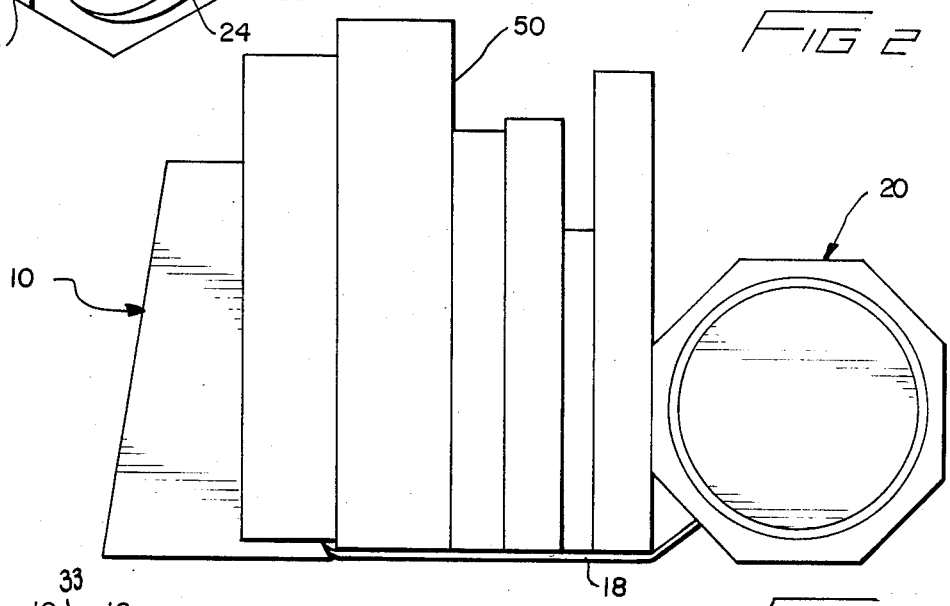
FIG. 2 is an elevational view of the retaining means showing the first polygonal element to the right and the second polygonal element to the left.

Turning now to FIG. 2 one can see the pair of polygonal elements 10 and 20 and the cord or tethering means connecting them at 18 and between the retention elements a series of objects such as books indicated at 50.

Figure 3:
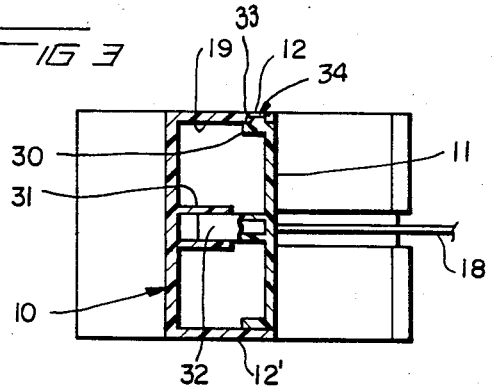
FIG. 3 is a bottom sectional view of the second polygonal element showing the spring biasing means.

Moving on to FIG. 3, which is a cross section taken through the line 3—3 of FIG. 1, one can view the side walls 12, 12' and the front wall 11, which front wall includes end portions indicated at 30 which are recessed within the inner walls 19 of the polygonal element 10. The inner side wall is provided with snaps 34 which fit recesses 33 in walls 12 and 12' to secure pieces. There can also be seen a sleeve 31 in which a complemental boss 32 on the inner portion of the front wall 11 can slide into place and be retained. The relationship of these wall portions can be seen even better by turning to FIG. 5 in its left-most view.

Figure 4:
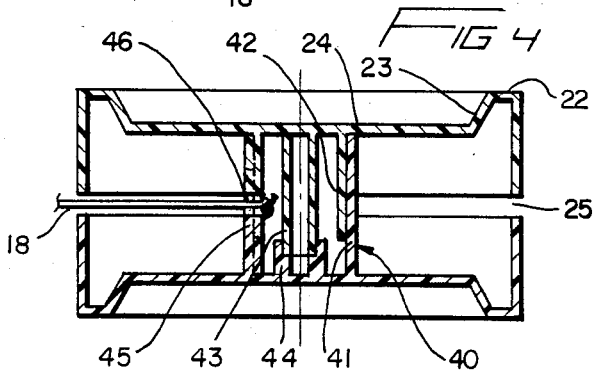
FIG. 4 is a cross sectional view of the first polygonal element showing the attachment of the cord to a central portion thereof.

Referring to FIG. 4 one views a cross section taken along line 4—4 of the polygonal body in FIG. 1 showing its two body portions retained together through a press fit connection. The outer planar wall 22, the indention wall 23 and the inner planar wall 24 can be seen, as well as the groove 25 and the cord 18. The fastening means between the two body portions 21, 21' is denoted generally at 40 and forms a central shaft in a pressed fit relation between the two body portions. It comprises an outer wall 41 on one body and an outer wall 42 on the other body which can be brought together in abutting concentric relation. There is also provided a boss 44 which receives a central inner shaft 43 to strengthen the union between the two body portions. There is further shown in this figure a slot 46 through which the cord 18 passes, the slot 46 being provided in wall 41 and 42 and a loop or knot means 45 for retention of the cord within the central core of the polygonal body.

Figure 5:
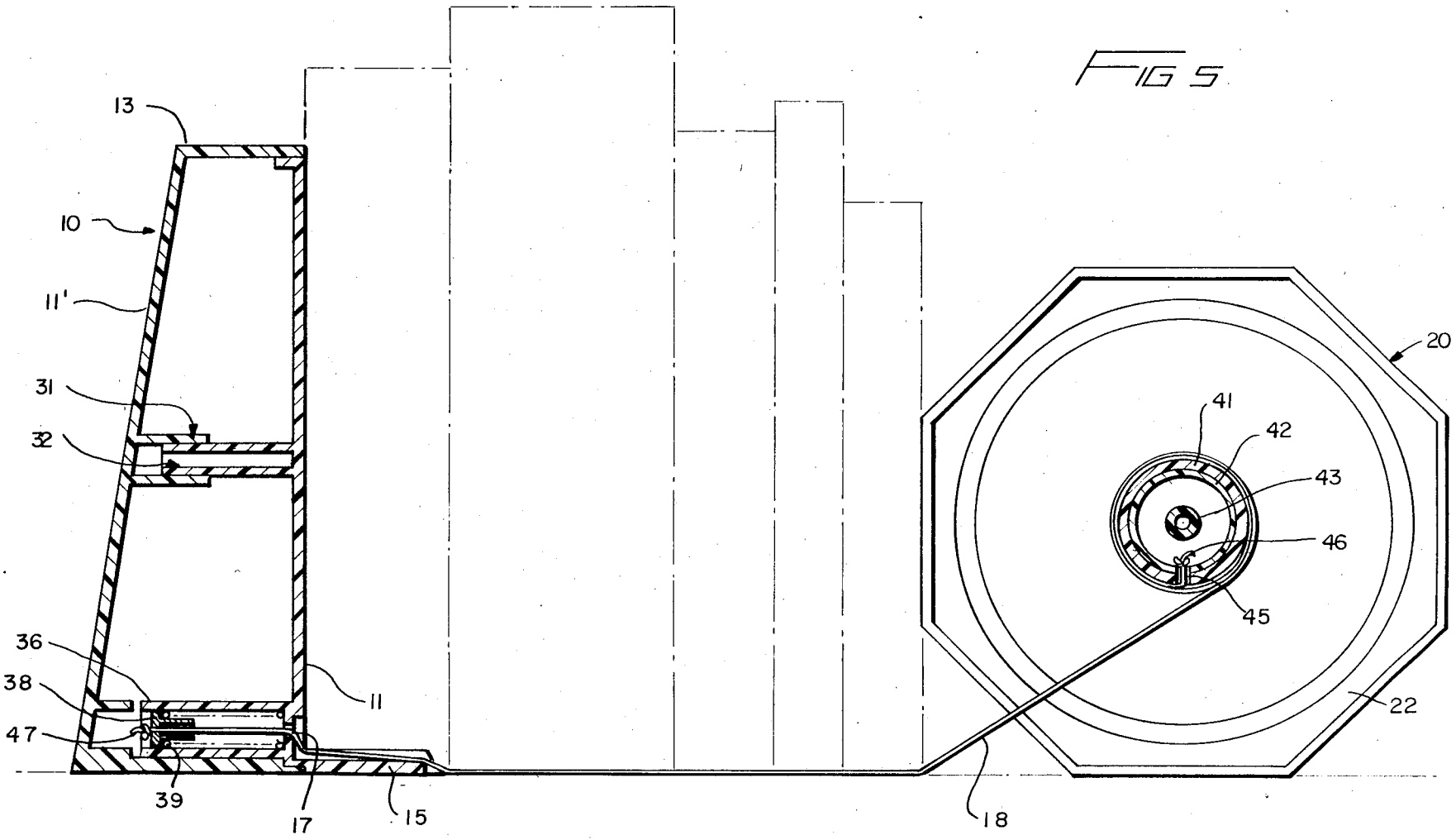
FIG. 5 is an elevational view in cross section of the retaining elements.

Turning now to FIG. 5, in the left-most portion of the figure one can view in sectional elevation the spring biased means provided for the cord which includes the aperture 17 through which the cord passes, the spring 39 and a sleeve 36, in which an eyelet means 38 is disposed. A securement means for the cord 18 is shown at 47 beyond the eyelet means. The pressure of compressing articles between the two polygonal bodies causes the cord to pull the eyelet against the spring through a series of steps in spring compression, the eyelet means moving in the direction of the front wall 11. Viewing the opposite side of the figure, with books shown in phantom representation therebetween, there is shown the octagonal polygonal element and its cores and shaft connections and the securement means at 45, 46 for the cord 18. It can be judged from the FIGS. 1 through 5 that the retention bodies have been proposed for manufacture in a synthetic substance such as plastic, in contrast to the further embodiment provided in FIGS. 6 and 7 for the manufacture of the dual clamping means in wood or a similar substance.

Referring to FIG. 6, the second embodiment of the invention is shown in exploded view in which 10' indicates the second polygonal body having a rear wall 11'', the front wall being shown provided with an aperture 17' and a blind bore 36' into which is disposed a spring 39' and an eyelet 38' with securement means, such as a knot, at 47. In this embodiment the second polygonal body comprises an upstanding element attached to a separate base provided with feet 15'', the attachment being made via a recess 19' in the bottom of the polygonal element 10' designed to complementally receive the base with protruding feet 15'', the attachment being made via apertures 35' into which securement means 34', such as nails, are disposed. Nails also retain the spring.

FIG. 7 further illustrates the construction of the second embodiment in a fashion similar to FIG. 5, the central shaft joining the body portions of the first polygonal element being noted as 41' and provided with a milled recess at 49 into which a pin 48 can extend through a loop 46' in cord 18' so as to secure that end of the cord tightly to the polygonal body central core. The opposite side of the view in FIG. 7 discloses the cross sectional embodiment of the second polygonal body in which eyelet 38' and spring 39' are shown and the base attached to the second polygonal body 10' via nails 34'. The blind bore for the eyelet 36' is also shown clearly in this view.

Having described the two embodiments, it would now be appropriate to indicate how uniquely the structure of the invention allows for use of the retention means as improvements on the state of the art. In use, the first polygonal body would be unwrapped or rotated, playing out the tethering means and moved laterally away from the second polygonal body. Objects would then be placed between the two bodies to whatever width was appropriate, and having done so the user would then begin to wind the first polygonal body in a rotational motion in the direction of the second polygonal body. In this fashion the cord would pass through the continuous groove and be wrapped about the central core of the first polygonal body until such point as one of the polygonal side walls was in abutting relationship with the objects to be held in retained upright relation. At that point an initial compression pressure would be established upon the objects to be stored. Additional compression and clamping pressure could be applied to those objects by continuing to rotate the first polygonal body so that the next side or a successive side thereof was in contact with the objects to be held. In winding the cord so that another side was in place against the objects, the following would occur:

The first polygonal element would be rotated such that a ridge portion or edge at 27 was abutting the objects and when the polygonal element was rotated such that the cord passed beyond the ridge portion, when viewed from the face thereof, the successive side wall of the polygonal body would snap tightly against the upright object in an "over-center" spring biased relationship. Continuing to wrap the cord about the core and bring a successive edge 27 and side 26 into play would bring a further overcenter snapping and tightening of the compression between the object retention elements.

The particular form of adjustability provided by this spring biasing and overcenter relationship of the multi-sided polygonal body with respect to the cord is completely novel in view of the prior art and allows for successive stages of tightening, as may be necessary depending upon either the weight of the objects to be held or the fragility of those objects to withstand successive levels of compression power applied by the retention elements. With heavy objects which would not stand up well by themselves without substantial strength being exerted at opposite ends, the first polygonal body could be wound into an extremely tight relationship with the books and the second polygonal body.

By contrast, if delicate material, such as the plastic cases of audio or video cassettes were the material desired to be stored between the retention means, the first polygonal body would be relatively loosely wrapped to secure those lighter, more delicate objects with the second polygonal body.

In the foregoing manner, the invention provides for highly adjustable tension and compression strength between the two elements comprising the retention means.

While specific embodiments of the invention have been hereinabove shown and described, it will be understood that variations therein are possible within the scope of the appended claims.

What is claimed and desired to be secured by Letters Patent of the United States is:

1. A pair of geometrical elements arranged to be secured in an operative position, comprising a rotatable first body having an axis and a continuous perimeter, said perimeter formed by at least one polygonal wall, said first body being provided with oppositely disposed faces terminating in said at least one polygonal wall, a second body having at least a front wall, a rear wall, a top wall, and a pair of side walls, said second body being further provided with tensioning means disposed proximately to said bottom wall and secured to one extremity of a tethering means, the opposite extremity of said tethering means being secured to a retention means therefor provided on said rotatable first body, where a series of objects may be placed between said bodies and retained in upstanding relation via the coaction of said tensioning means and said retention means when said first body is rotated about its axis.

2. A device as claimed in claim 1, wherein said retention means comprises a connecting means disposed between said oppositely disposed faces for positively joining said faces together.

3. A device as claimed in claim 1, wherein said tethering means is arranged to enter means defining an aperture in said front wall in said second body and be positively secured to said tensioning means.

4. A device as claimed in claim 1, wherein said tensioning means comprises a eyelet means and a spring member in abutting relation.

5. a device as claimed in claim 1, wherein said tensioning means comprises a spring-biased eyelet disposed in a blind bore.

6. A device as claimed in claim 1, wherein said second body includes means for securing said front wall to said back wall.

* * * * *